US010058788B2

(12) United States Patent
Burger

(10) Patent No.: US 10,058,788 B2
(45) Date of Patent: Aug. 28, 2018

(54) TRACK SYSTEM FOR AN AMUSEMENT RIDE, IN PARTICULAR FOR A ROLLER COASTER OR SUSPENSION RAILWAY

(71) Applicant: MACK RIDES GMBH & CO. KG, Waldkirch (DE)

(72) Inventor: Günter Burger, Waldkirch (DE)

(73) Assignee: MACK RIDES GMBH & CO. KG, Waldkirch (DE)

( * ) Notice: Subject to any disclaimer, the term of this patent is extended or adjusted under 35 U.S.C. 154(b) by 206 days.

(21) Appl. No.: 15/023,308

(22) PCT Filed: Sep. 25, 2014

(86) PCT No.: PCT/EP2014/070541
§ 371 (c)(1),
(2) Date: Mar. 18, 2016

(87) PCT Pub. No.: WO2015/049162
PCT Pub. Date: Apr. 9, 2015

(65) Prior Publication Data

US 2016/0250560 A1 Sep. 1, 2016

(30) Foreign Application Priority Data

Oct. 2, 2013 (DE) ..... 10 2013 220 067

(51) Int. Cl.
*A63G 7/00* (2006.01)
*B61B 3/00* (2006.01)

(52) U.S. Cl.
CPC . *A63G 7/00* (2013.01); *B61B 3/00* (2013.01)

(58) Field of Classification Search
CPC . E01B 25/00; E01B 25/08; B61B 3/00; B61B 3/02; B61B 13/00; B61B 13/04; B61B 13/06; A63G 7/00
See application file for complete search history.

(56) References Cited

U.S. PATENT DOCUMENTS 629,273 A 7/1899 Rieppel
3,949,680 A 4/1976 Doughty
(Continued)

FOREIGN PATENT DOCUMENTS

DE 20 2009 008256 U1 1/2010
EP 2 156 870 A1 7/2009

OTHER PUBLICATIONS

International search report for related application PCT/EP2014/070541 dated Jan. 15, 2015.
(Continued)

*Primary Examiner* — Robert J McCarry, Jr.
(74) *Attorney, Agent, or Firm* — William Gray Mitchell

(57) ABSTRACT

A track system for amusement rides with truss-like track elements, which consist of at least one three girder system and comprise, as the first and second girder elements, tracks extending alongside each other, and at least one other girder element, wherein a first stiffening plane is formed by means of the tracks and cross beams connecting the tracks, and second and third stiffening planes are formed in each case by means of one track and the transverse struts, connecting said track to the at least third girder element; and, in order to form the track sections, the cross beams and the transverse struts are arranged spaced apart.

14 Claims, 6 Drawing Sheets

(56) References Cited

U.S. PATENT DOCUMENTS

| | | | | |
|---|---|---|---|---|
| 4,489,659 | A | 12/1984 | Kamohara et al. | |
| 6,047,645 | A * | 4/2000 | Cornwell | A63G 7/00 104/124 |
| 2002/0017754 | A1 | 2/2002 | Kang | |
| 2004/0083922 | A1 | 5/2004 | Gnezdilov | |

OTHER PUBLICATIONS

Office Action dated Mar. 12, 2014 by German Patent and Trademark Office for related application 10 2013 220 067.6.

* cited by examiner

TRACK SYSTEM FOR AN AMUSEMENT RIDE, IN PARTICULAR FOR A ROLLER COASTER OR SUSPENSION RAILWAY

CROSS REFERENCE TO RELATED APPLICATIONS

This patent application claims priority International Patent Application PCT/EP2014/070541, filed on Sep. 25, 2014, and thereby to German Patent Application 10 2013 220 067.6, filed on Oct. 2, 2013.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention relates to a track system for an amusement ride, in particular for a roller coaster or suspension railway.

Background of the Invention

The invention relates to a track system for amusement rides with truss-like track elements in accordance with the preamble of patent claim 1 and to an amusement ride, preferably a roller coaster or a suspension railway with a track system according to the invention.

Such a track system for a roller coaster ride with truss-like track elements is known from the European patent EP 2 156 870 B1, where a section of this track system is depicted in FIG. 6, which shows two interconnected track elements 1 of a track system 10.

Each track element 1 consists of a three girder system with tubular tracks 2 and 3, running parallel to each other, as the first and second girder elements, and a third girder element, which is arranged in a triangle configuration relative to these tracks and is designed as a tension or compression element 4, where in this case these tracks 2 and 3 as well as this tension element 4 are connected in sections in such a way that they form the track sections 1.1 to 1.7 by means of the cross beams 5 and 5.1 and the transverse struts 6 and 6.1. The cross beams 5 and 5.1 connect, as the spacers, the two tracks 2 and 3 and form with these two tracks a first stiffening plane A1, while two transverse struts 6 and 6.1 connect the tracks 2 and 3 with the tension element 4 to form a second and third stiffening plane A2 and A3. The ends of the cross beams 5 and 5.1 form together with the tracks 2 and 3 and with the ends of the transverse struts 6 and 6.1 two vertices of a triangle, with the third vertex being formed by the ends, which are connected to the tension element 4 and which belong to the transverse struts 6 and 6.1.

The cross beams 5.1 differ from the cross beams 5 in that the cross beams 5.1 with the associated traverse struts 6.1 are provided with a column joint 9 having a column head 9.1. The track elements 1 are connected by means of such a column head 9.1 to vertical columns that are anchored underground, so that the whole track system is supported by such columns. Such columns may be designed not only vertically and in a supporting manner, but may also be used for any type of support arrangement.

Such a column joint 9 is designed as a two dimensional element having a triangular contour, so that this two dimensional element can be connected on the contour side to a cross beam 5.1 and to the associated transverse struts 6.1.

In order to increase the stability and rigidity of the track system 10, each track section 1.1 to 1.7 is provided with three diagonal struts 7.0, 7.1 and 7.2, which lie in the first, second and third stiffening plane A1, A2 and A3, and in each case diagonally bridge said stiffening plane between the track sections 1.1 to 1.7. Thus, for example, in the case of the track section 1.1 the two diagonal struts 7.1 and 7.2, which are located in the second and third stiffening planes A2 and A3, connect the ends of the cross beam 5.1, said ends being connected to the tracks 2 and 3 respectively, to the ends of the adjacent transverse struts 6, said ends being connected to the tension element 4, while the diagonal strut 7.0, located in the first stiffening plane A1, connects the end of the cross beam 5.1, said end being connected to the track 3, to the diagonally opposite end of the cross beam 5, which forms a vertex with the track 2.

The individual track elements 1 are connected to each other by means of not only the flanges 4.11 and 4.12, which are disposed on the ends of the tension elements 4, by means of a screw connection but also by means of welded joints of the tracks 2 and 3.

The object of the present invention is to further develop a track system of the type described in the introductory part in such a way that a higher fatigue strength with an increased number of load cycles is achieved; or, more specifically, that longer distances from the tension element are possible with the same or modified cross section of the tracks.

This engineering object is achieved by means of a track system exhibiting the features disclosed in patent claim 1.

BRIEF SUMMARY OF THE INVENTION

In a preferred embodiment, a track system (10) for amusement rides with truss-like track elements (1), which consist of at least one three girder system and comprise, as the first and second girder elements, tracks (2, 3), extending alongside each other, and at least one other girder element (4.1), wherein a first stiffening plane (A1) is formed by means of the tracks (2, 3) and the cross beams (5, 5.1), connecting these tracks (2, 3); and a second and a third stiffening plane (A2, A3) are formed by means of one track (2, 3) and the transverse struts (6, 6.1), connecting said track to the at least third girder element (4.1); and, in order to form the track sections (1.1, . . . , 1.7), the cross beams (5, 5.1) and the transverse struts (6) are arranged spaced apart, characterized in that at least one track section (1.1, 1.2, 1.5, 1.6, 1.7), formed by the adjacent cross beams (5, 5.1) with the associated transverse struts (6, 6.1), is designed with a stiffening element (7.3), which spans the track section (1.1, 1.2, 1.3, 1.5, 1.6, 1.7) in such a way that the stiffening element (7.3) together with the other girder element (4.1) of the track section (1.1, 1.2, 1.3, 1.5, 1.6, 1.7) forms a fourth stiffening plane (A4).

In another preferred embodiment, the track system (10), as disclosed herein, characterized in that the stiffening element (7.3) diagonally spans the track section (1.1, 1.2, 1.3, 1.5, 1.6, 1.7).

In another preferred embodiment, the track system (10), as disclosed herein, characterized in that the stiffening element (7.3) is connected at one end to the one cross beam (5, 5.1) of the track section (1.1, 1.2, 1.3, 1.5, 1.6, 1.7) and at the other end is connected in that connecting region that connects the transverse struts (6, 6.1), associated with the other cross beam (5, 5.1), to the other girder element (4.1).

In another preferred embodiment, the track system (10), as disclosed herein, characterized in that the stiffening element (7.3), forming the fourth stiffening plane (A4), is connected to the other girder element (4.1).

In another preferred embodiment, the track system (10), as disclosed herein, characterized in that the stiffening element (7.3), forming the fourth stiffening plane (A4), is connected to the traverse strut (6, 6.1).

In another preferred embodiment, the track system (10), as disclosed herein, characterized in that at least one cross beam (5.1) with the associated transverse struts (6.1) is connected to a column joint (9), comprising a column head (9.1); and that the stiffening element (7.3), forming the fourth stiffening plane (A4), is connected to the column joint (9).

In another preferred embodiment, the track system (10), as disclosed herein, characterized in that the stiffening element (7.3), forming the fourth stiffening plane (A4), is connected preferably centrally to the cross beam (5, 5.1).

In another preferred embodiment, the track system (10), as disclosed herein, in that the at least one track section (1.1, 1.2, 1.6, 1.7) has a first and second stiffening strut (8.1, 8.2), which at one end is centrally connected to a cross beam (5, 5.1) of the track section (1.1, 1.2, 1.6, 1.7) and at the other end, spanning the track section (1.1, 1.2, 1.6, 1.7), is connected in each instance at the opposite cross beam (5, 5.1) of the track section (1.1, 1.2, 1.6, 1.7) on the end side to this cross beam (5, 5.1) or to the transverse struts (6, 6.1), connected to this cross beam (5, 5.1).

In another preferred embodiment, the track system (10), as disclosed herein, characterized in that the at least one track section (1.1, 1.2, 1.6, 1.7) has a third stiffening strut (8.3), which connects the two cross beams (5, 5.1) of the track section (1.1, 1.2, 1.6, 1.7) in the middle.

In another preferred embodiment, the track system (10), as disclosed herein, characterized in that at least one track section (1.1, . . . , 1.7) in the first and/or second and/or third stiffening plane (A1, A2, A3) is constructed with each diagonal strut (7.0, 7.1, 7.2, 7.4), spanning the track section (1.1, . . . , 1.7).

In another preferred embodiment, the track system (10), as disclosed herein, characterized in that the track elements (1) consist of a four girder system and comprise, as a first and second girder element, tracks (2, 3), running almost parallel to each other, and two other girder elements (4.1, 4.2), wherein the fourth stiffening plane (A4) is formed by means of a (7.3), which spans the track section (1.1, 1.2, 1.3, 1.5, 1.6, 1.7) in such a way that the stiffening element (7.3) forms together with one of the other girder elements (4.1, 4.2) of the track section (1.1, 1.2, 1.3, 1.5, 1.6, 1.7) a fourth stiffening plane (A4).

In another preferred embodiment, the track system (10), as disclosed herein, characterized in that the stiffening element is designed as a diagonal strut (7.3).

In another preferred embodiment, the track system (10), as disclosed herein, characterized in that the column joint (9) is designed as a two dimensional element, which has a triangular contorectangular contour and which is connected to the cross beam (5.1) and the two transverse struts (6.1) in a force fitting manner on the contour side.

In another preferred embodiment, the track system (10), as disclosed herein, characterized in that the column head (9.1) is disposed on the least one girder element (4.1, 4.2) and, for connecting to a column of the track system (10), is designed preferably for a roller coaster or suspension railway.

In another preferred embodiment, an amusement ride, preferably roller coaster or suspension railway with a track system (10), as disclosed herein.

DETAILED DESCRIPTION OF THE INVENTION

Figure 1:
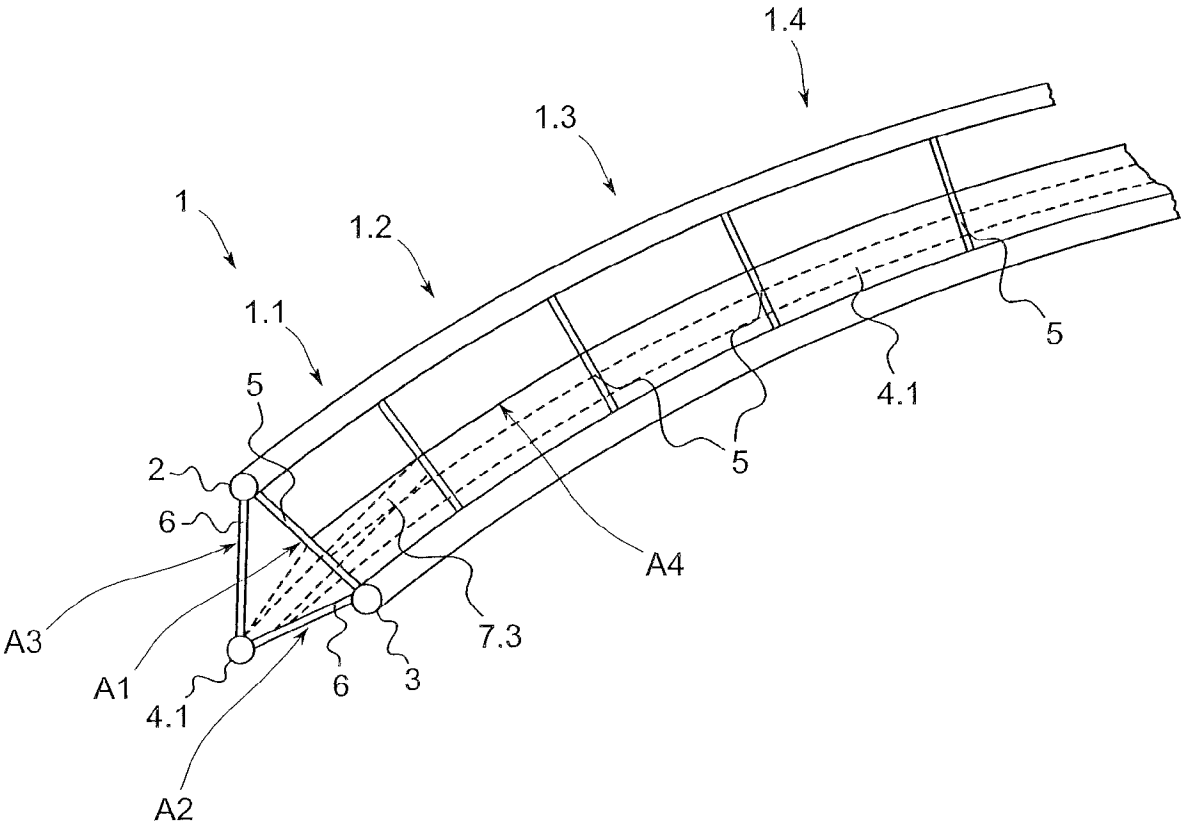
FIG. 1 is a line drawing evidencing a diagrammatic representation of a track element as a three girder system according to the invention.

I disclose a track system for amusement rides with truss-like track elements, which consist of at least one three girder system and comprise, as the first and second girder elements, tracks, extending alongside each other, and at least one other girder element, wherein a first stiffening plane is formed by means of the tracks and the cross beams, connecting these tracks; and a second and a third stiffening plane are formed in each case by means of one track and the transverse struts, connecting said track to the at least third girder element; and, in order to form the track sections, the cross beams and the transverse struts are arranged spaced apart, characterized, according to the invention, in that at least one track section, formed by the adjacent cross beams with the associated transverse struts, is designed with a stiffening element, which spans the track section in such a way that the stiffening element together with the other girder element of the track section forms a fourth stiffening plane.

With such a stiffening element, forming such a fourth stiffening plane, it is possible to achieve a higher fatigue strength, so that a higher number of load cycles is also possible.

In order to form the fourth stiffening plane, this stiffening element can span the track section in such a way that this fourth stiffening plane does not have to run in the direction of the second and third stiffening plane inside a track section, but rather can also be connected, as required, to the cross beams, which form the track section, with the associated transverse struts as well as to the other girder element.

It is particularly advantageous according to a further development of the invention for the stiffening element to be arranged in such a way that the track section is spanned diagonally.

According to a further development of the invention, it is provided that the stiffening element is connected at one end to the one cross beam of the track section and at the other end in that connecting region that connects the transverse struts, associated with the other cross beam, with the other girder element.

According to a preferred embodiment of the invention, the stiffening element, which forms the fourth stiffening plane, is connected with its end, opposite the cross beam, to the other girder element of the three girder system or, when using a four girder system, to one of the two other girder elements. As an alternative, it is also possible, according to a further development, to connect the end of the stiffening element to one of the traverse struts, associated with the other cross beam.

Furthermore, it is provided, according to an advantageous embodiment, that at least one cross beam with the associated transverse struts is connected to a column joint, comprising a column head, and that the stiffening element, which forms the fourth stiffening plane, is connected to the column joint.

It is particularly preferred that the stiffening element, forming the fourth stiffening plane, be connected to the cross beam in the middle.

An advantageous embodiment of the invention provides that the at least one track section has a first and second stiffening strut, which at the one end is connected in the middle of a cross beam of the track section, and at the other end, spanning the track section, is connected in each instance at the opposite cross beam of the track section on the end side to this cross beam or to the transverse struts, connected to this cross beam. This arrangement achieves the objective of reinforcing the track element. In this embodiment of the invention the at least one track section has preferably a third stiffening strut, which connects the two cross beams of the track section in the middle.

Furthermore, an additional advantageous embodiment provides that at least one track section in the first and/or second and/or third stiffening plane is constructed with a diagonal strut, which in each instance spans the track section.

According to another advantageous embodiment of the invention, it is provided that the track elements consist of a four girder system and comprise, as the first and second girder elements, tracks, which run parallel to each other, and two other girder elements, wherein in this case said fourth stiffening plane is formed by means of a stiffening element, which at the one end is connected to a cross beam and at the other end spans the track section in such a way that the stiffening element together with one of the other girder elements of the track section forms a fourth stiffening plane. It is also possible to form a fifth stiffening plane as a mirror image of said fourth stiffening plane.

A simple structural design is provided by a further development of the invention when the stiffening element is designed as a diagonal strut.

Furthermore, another embodiment of the invention provides that the column joint is designed as a two dimensional element with a triangular contour when using a three girder system or with a rectangular contour when using a four girder system, where in this case the two dimensional element is connected to the cross beam and the two transverse struts on the contour side with almost no break in the surface.

At the same time a further development of the invention provides that the column joint is constructed as a two dimensional element, which has a triangular contour and which is connected to the cross beam and the two transverse struts on the contour side with almost no break in the surface. Preferably the column head is disposed on at least one girder element and is designed to connect to a support of the track system, preferably for a roller coaster or a suspension railway.

The inventive track system with the truss-like track elements lends itself for use for amusement rides, in particular, roller coasters or suspension railways and can also be retrofitted in vehicle-bound rail systems that are already in service.

All of the triangular and rectangular constructions described herein relate to theoretical, static vertices. The theoretical/static nodal points are moved/rerouted due to the clearances, which are required for the vehicle chassis, or due to the production-dependent free spaces (for example, the tracks 2 and 3, which act as girders, are offset from the nodal points of A2 and A3 to A1.). As an alternative, all of the struts may also be two dimensional elements.

DETAILED DESCRIPTION OF THE FIGURES

Figure 2:
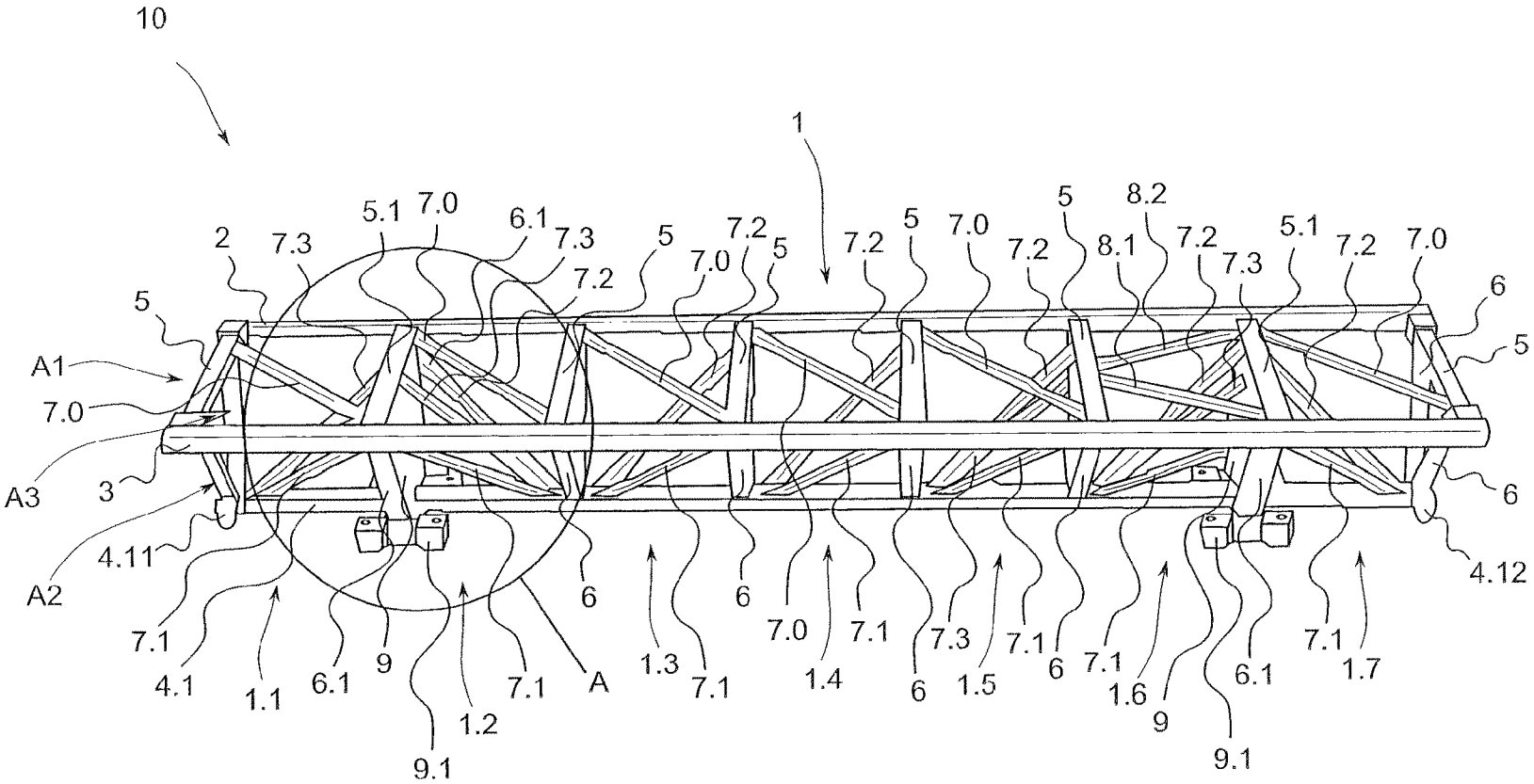
FIG. 2 is a line drawing evidencing a perspective view of a track element as a three girder system in a concrete embodiment of the invention.

The truss-like track element 1, depicted in FIGS. 1 and 2, is part of a track system 10, which consists of such interconnected track elements 1 and can be used for amusement rides, for example, for a roller coaster or for a suspension railway.

The representation of a track element 1, which is shown in schematic form in FIG. 1 as compared to FIG. 2, consists of a three girder system comprising a first and second girder element as the tracks 2 and 3 and an additional, thus, third girder element 4.1, which in used, as a function of the generated loads, as a tension or compression element. The three girder elements 2, 3 and 4.1 are designed in the shape of an arch and run alongside each other. In straight sections the girder elements also run parallel to each other. The two tracks 2 and 3 form together with the cross beams 5, which connect these tracks 2 and 3, a first stiffening plane A1. The two tracks 2 and 3 are connected by means of the transverse struts 6 to the other girder element 4.1. In this case one cross beam 5 and two transverse struts 6 are located at defined intervals in a plane, which extends transversely to the tracks 2 and 3, and in this way divide the track element 1 into the track sections 1.1, 1.2, 1.3, 1.4 and so on. At the same time the transverse struts 6, which connect the track 3 to the other girder element 4.1, form a second stiffening plane A2; and the transverse struts 6, which connect the track 2 to the other girder element 4.1, form a third stiffening plane A3.

According to the invention, a fourth stiffening plane A4 is formed by means of a stiffening element 7.3, which is designed as a diagonal strut and which diagonally spans in each instance a track section (see FIG. 1, track section 1.1). For this purpose one end of such a diagonal strut 7.3 is connected to a cross beam 5, which forms the track section 1.1, whereas the other end of such a diagonal strut is connected in the connecting region of the transverse struts 6 to the other girder element 4.1, thus directly to this other girder element 4.1 or to one of the two transverse struts 6. According to this FIG. 1, this diagonal strut 7.3 is connected to the cross beam 5 in the middle, but it is also possible to connect the diagonal strut 7.3 to the cross beam 5 outside of the center. With this fourth stiffening plane A4 it is not only possible to improve the dynamic load capacity, but also the static situation. The other girder element 4.1 is loaded as a bottom girder under tension and pressure as a function of the dynamics.

This stiffening element 7.3 can be designed as any type of element and can be connected to any type of connecting point that is made available to the girder element 4.1 by and with the assistance of the two cross beams 5, forming a track section 1.1 to 1.4, with the associated transverse struts 6 and the other girder element 4.1 in the connecting area of these transverse struts 6.

Figure 8:
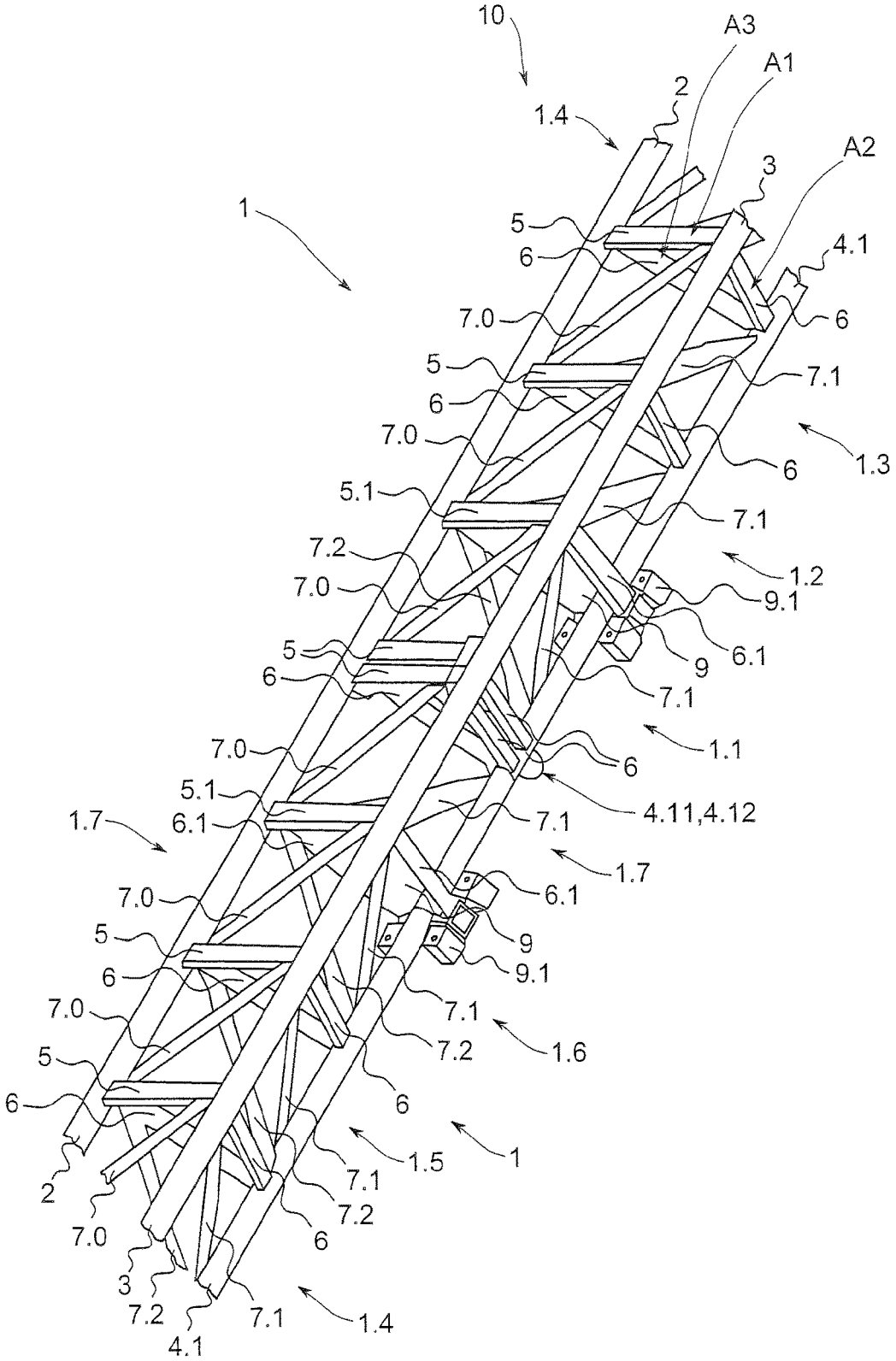
FIG. 8 is a line drawing evidencing a perspective view of two interconnected track elements according to the prior art.

In its basic structure, the track element 1, according FIG. 2, corresponds to the track element, known from the prior art according to the European patent EP 2 156 870 B1, and the track element 1, shown in FIG. 8. In this case, however, it is also possible to achieve, according to FIG. 1, a fourth stiffening plane A4 by means of the diagonal struts 7.3.

In an analogous manner this track element 1, according to FIG. 2, comprises a three girder system with a first and second girder element 2 and 3, which are designed as the tracks 2 and 3 respectively, and with a third or more specifically, an additional girder element 4.1, which is designed as the tension or compression element. The two parallel running tracks 2 and 3 are connected to each other, on the one hand, in order to form the first stiffening plane A1 across the cross beams 5 or 5.1, and, on the other hand, are connected in each instance to the other girder element 4.1 by means of the transverse struts 6 or 6.1. The track 3 forms together with the transverse struts 6 and the other girder element 4.1 the second stiffening plane A2; and the track 2 forms together with the transverse struts 6 and the other girder element 4.1 the third stiffening plane A3. The ends of the other girder element 4.1 are formed with the flanges 4.11 and 4.12, which are necessary for connecting the track elements 1 to a track system 10.

In each case one cross beam 5 or 5.1 and two transverse struts 6 or 6.1 are arranged in a plane, which extends transversely to the tracks 2 and 3 or the other girder element 4.1, so that the track sections 1.1 to 1.7 are produced in this way.

The cross beams 5.1 differ from the cross beams 5 in that the cross beams 5.1 with the associated transverse struts 6.1 are provided with a column joint 9, which has a column head 9.1. Such a column head 9.1 allows the track elements 1 to be connected to the vertical columns, which are anchored underground, so that the entire track system is supported by such columns. Any type of support arrangement is also possible, for example, for a suspension railway.

Such a column joint 9 is designed as a two dimensional element with a triangular contour, so that this two dimensional element can be connected on the contour side to a cross beam 5.1 as well as to the associated transverse struts 6.1.

Furthermore, all of the track sections 1.1 to 1.7 are provided with diagonal struts 7.1 and 7.2, each of which is connected with one end to the cross beams 5 or 5.1 and with its other end, diagonally bridging the respective track section, to the other girder element 4.1, where they form with the ends of the opposite transverse struts 6 a vertex.

As a result, starting from the cross beam 5.1 of the adjacent track sections 1.1 and 1.2, two diagonal struts 7.1 and 7.2 are provided on both sides; in each case these opposite diagonal struts are connected to the other girder element 4.1 at the ends of the opposite transverse struts 6 of the track sections 1.1 and 1.2. A corresponding structure can also be seen at the cross beam 5.1 of the track sections 1.6 and 1.7. Two diagonal struts 7.1 and 7.2 are also connected to the cross beams 5 of the adjacent track sections 1.3 and 1.4, the adjacent track sections 1.4 and 1.5 as well as the adjacent track sections 1.5 and 1.6 and extend diagonally across each track section up to the vertex, which is formed in each case by the opposite transverse struts 6 with the other girder element 4.1.

Furthermore, a diagonal strut 7.0, which diagonally bridges the track sections 1.1 to 1.5 and 1.7, is also provided in the plane of the tracks 2 and 3. This diagonal strut 7.0 connects the vertex, formed by a cross beam 5 or 5.1 with the track 2, to the diagonally opposite end of the cross beam 5 or 5.1, which forms a vertex with the track 3.

Figure 3:
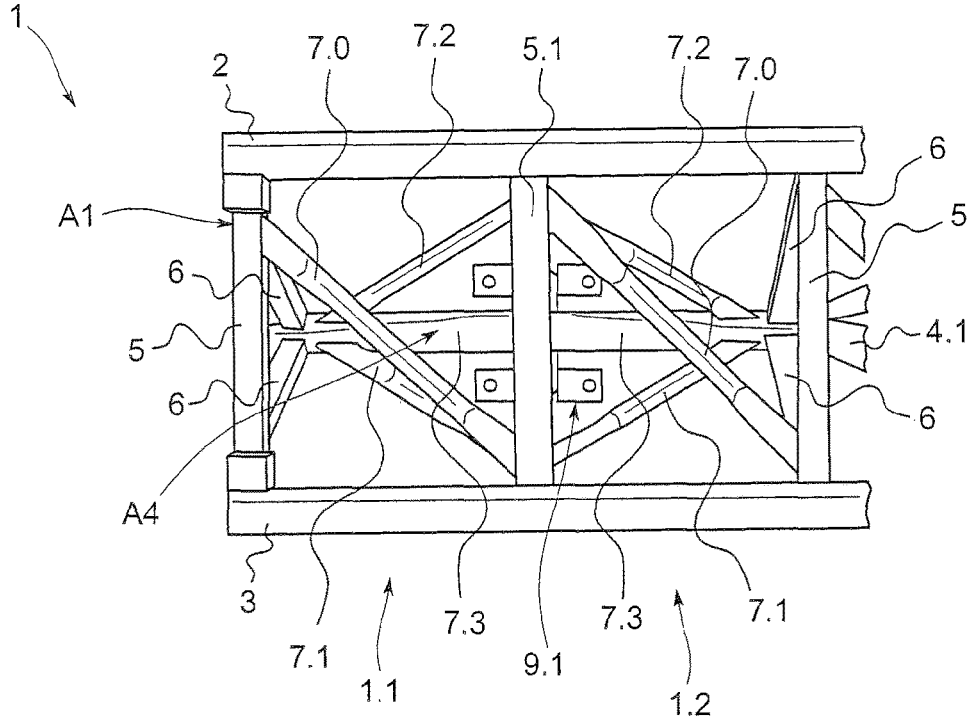
FIG. 3 is a line drawing evidencing a perspective view of a detail A, according to FIG. 2, in a plan view of the tracks of the track element.
Figure 4:
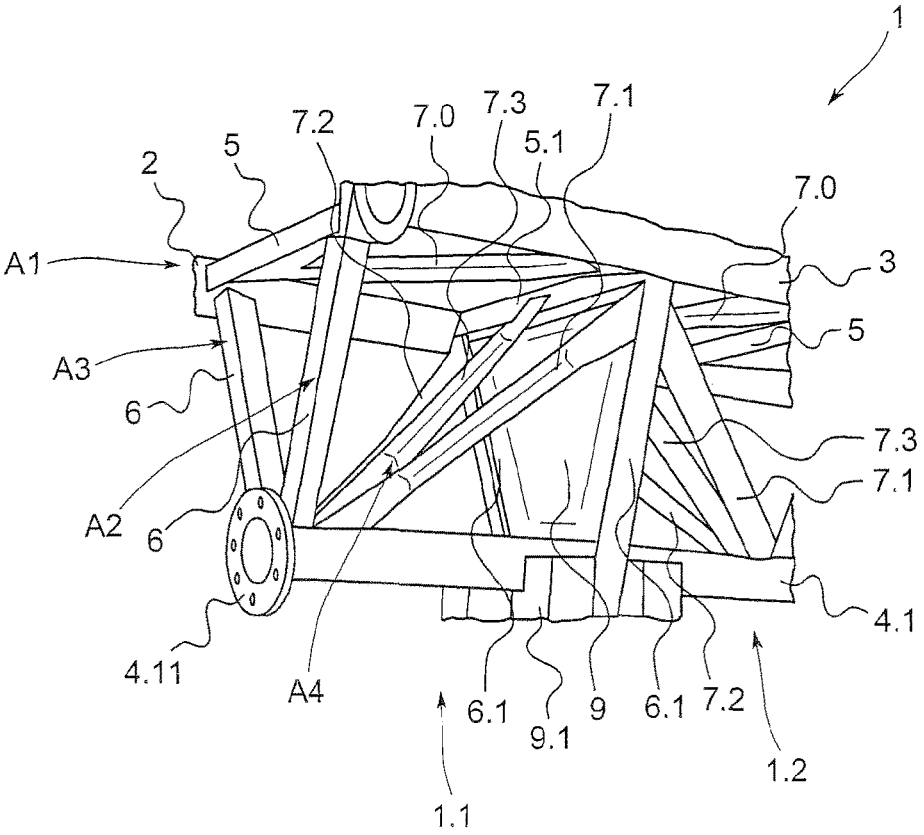
FIG. 4 is a line drawing evidencing a perspective view of a detail A, according to FIG. 2, in a side view.

Referring to the detail A according to FIG. 2, which is also shown in a plan view of the tracks 2 and 3 according to FIG. 3 and in a side view according to FIG. 4, a diagonal strut 7.3, which spans the track section 1.1 and 1.2 respectively, is arranged in the two track sections 1.1 and 1.2 respectively, as a stiffening element of the fourth stiffening plane A4. These two diagonal struts 7.3 are centrally connected preferably with one end to the cross beam 5.1 and converge with their other end on the ends, which are connected to the other girder element 4.1 and which belong to the two diagonal struts 7.1 and 7.2, where they are also connected to the other girder element 4.1.

Such a structure with a diagonal strut 7.3 as a stiffening element of the fourth stiffening plane A4 is shown in FIG. 2 and can also be seen in the adjacent track sections 1.6 and 1.7, where each of such a diagonal strut 7.3 is connected in the middle of the cross beam 5.1, which connects these two track sections 1.6 and 1.7, and diagonally bridges each one of these track sections 1.6 and 1.7 in the direction of the other girder element 4.1.

Finally, the track section 1.5, according to FIG. 2, is also provided with such a diagonal strut 7.3 as a stiffening element of the fourth stiffening plane A4. Said diagonal strut is also connected in the middle of the cross beam 5, which connects the two track sections 1.5 and 1.6, and diagonally bridges the track section 1.5 in the direction of the other girder element 4.1.

According to FIG. 2, the track section 1.6 is designed with a first stiffening strut 8.1 and a second stiffening strut 8.2 in such a way that these two stiffening struts 8.1 and 8.2 run in the plane, formed by the two tracks 2 and 3. The two stiffening struts 8.1 and 8.2 are connected with one end to the cross beam 5.1 and extend towards each other in the shape of a V, so that they can be connected to the adjacent cross beam 5 in the middle.

Figure 5:
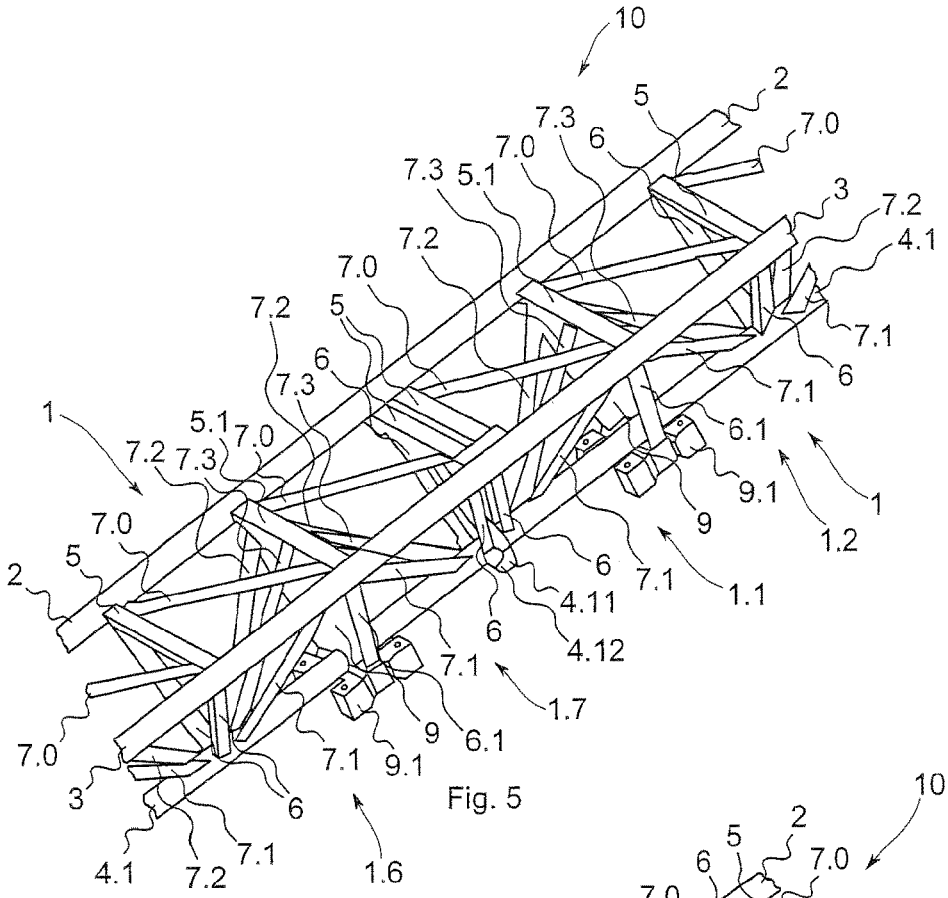
FIG. 5 is a line drawing evidencing a perspective view of a section of two interconnected track elements, according to one exemplary embodiment of the invention.

FIG. 5 shows two track elements 1, which are connected by means of the flanges 4.11 and 4.12, with the track sections 1.6 and 1.7 or 1.1 and 1.2 respectively, which correspond in terms of structure to the track sections 1.1 and 1.2 according to FIG. 1.

As a result, the cross beam 5.1, which connects the two track sections 1.6 and 1.7, as well as the associated transverse struts 6.1 are designed with a column joint 9, which exhibits a column head 9.1. Two diagonal struts 7.1 and 7.2 and one each diagonal strut 7.3 are connected to said cross beam 5.1 as the stiffening element of the fourth stiffening plane A4 and extend diagonally across the track section 1.6 and 1.7 to the nodal point, which is formed by the ends of the respective opposite transverse struts 6 with the other girder element 4.1. The track sections 1.1 and 1.2 of the other track section 1 are also constructed in a similar way with a cross beam 5.1, which connects said track sections and has a column foot 9 with a column head 9.1; therefore, these track sections correspond to those track sections 1.1 and 1.2 of the track element 1 according to FIG. 2.

Figure 6:
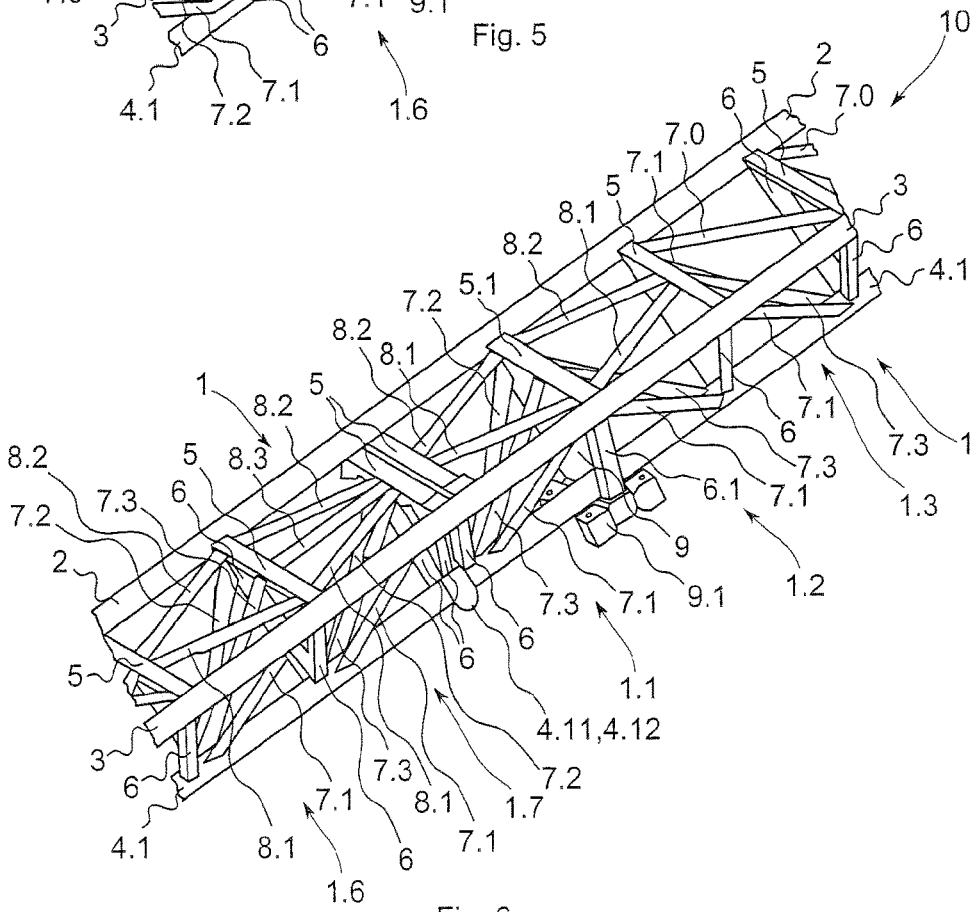
FIG. 6 is a line drawing evidencing a perspective view of a section of two interconnected track elements, according to another exemplary embodiment of the invention.

FIG. 6 also shows two track sections 1.1 and 1.2, which are connected by means of the flanges 4.1 and 4.2, as an additional exemplary embodiment. The track section 1.1 of the track element 1 according to FIG. 6 is constructed in the same way as that track section 1.6 of the track element 1 according to FIG. 2 and also has, in addition to the diagonal strut 7.3 as a stiffening element of the fourth stiffening plane A4, two additional stiffening struts 8.1 and 8.2. Furthermore, in addition to a diagonal strut 7.3 as the stiffening element of the fourth stiffening plane A4, a first stiffening strut 8.1 and a second stiffening strut 8.2 are also provided at the cross beam 5.1, which forms the track section 1.1, in the direction of the adjacent track section 1.2. These two stiffening struts 8.1 and 8.2 of the track section 1.2 are connected with each of their ends to a respective end of the cross beam 5.1 and also extend in a V shape towards the center of the opposite cross beam 5. The adjoining track section 1.3 also has, besides the two diagonal struts 7.1 and 7.2, a diagonal strut 7.3 as the stiffening element of the fourth stiffening plane A4, but, instead of the two stiffening struts 8.1 and 8.2, a diagonal strut 7.0 is provided.

The last two track sections 1.6 and 1.7 of the other track element 1 according to FIG. 6 also have a diagonal strut 7.3 as the stiffening element of the fourth stiffening plane A4, where in this case this diagonal strut 7.3 and the two diagonal struts 7.1 and 7.2 are connected to a cross beam 5 at the end of the track element 1 or to a cross beam 5, connecting the two track sections 1.6 and 1.7.

Starting from this cross beam 5, which connects the two track sections 1.6 and 1.7, a first and a second stiffening strut 8.1 and 8.2 are connected, on the one hand, to the end of this cross beam 5, in the direction of the track section 1.6; and, on the other hand, a first and a second stiffening strut 8.1 and 8.2 are connected in each instance to the end of this cross beam 5 in the direction of the track section 1.6. At the same time these two stiffening struts 8.1 and 8.2 converge in the shape of a V towards the middle of the opposite cross beam 5 in each of the two track sections 1.6 and 1.7.

The track section 1.7 has a third stiffening strut 8.3, which connects the two cross beams 5 in the middle.

Figure 7:
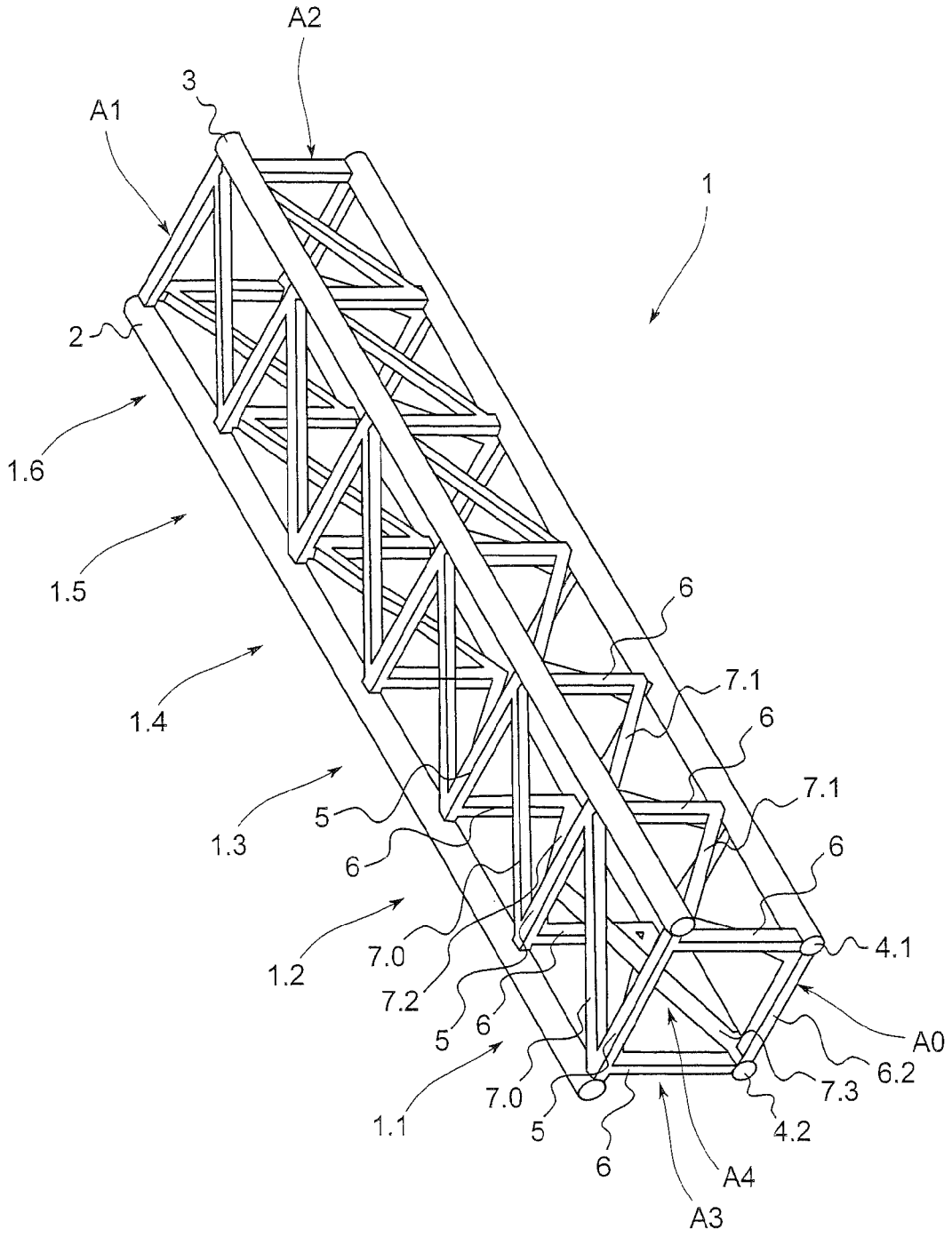
FIG. 7 is a line drawing evidencing in schematic form a perspective view of a track element as a four girder system, according to the invention.

FIG. 7 shows a track element 1 of a track system 10, which is constructed by means of a four girder system. This four girder system consists of a first and a second girder element, both of which together form the parallel tracks 2 and 3, as well as two other girder elements, i.e., a third and a fourth girder element 4.1 and 4.2. The two tracks 2 and 3 are spaced apart by means of the cross beams 5 and form together with these cross beams a first stiffening plane A1. The other two girder elements 4.1 and 4.2 are connected by means of the transverse struts 6.2 and the additional transverse struts 6 to the tracks 2 and 3 to form a stiffening plane A0, which runs parallel to the first stiffening plane A1. The other two girder elements 4.1 and 4.2 form in each case together with a track 3 and 2 respectively and the associated transverse struts 6 a second and third stiffening plane A2 and A3. The cross beams 5 are disposed together with the transverse struts 6 and 6.2 spaced apart in planes, which extend in each case transversely to the tracks 2 and 3, so that the track element 1 is thereby divided into the track sections 1.1 to 1.6. The track sections 1.1 to 1.6 have diagonal struts 7.0, 7.1, 7.2 and 7.4, each of which is arranged in the stiffening planes A1, A2, A3 and A0.

In order to form a fourth stiffening plane A4, a diagonal strut 7.3 is arranged in the track section 1.1 as the stiffening element and spans diagonally this track section 1.1. To this end this diagonal strut 7.3 is connected at one end in the middle of a cross beam 5, which forms the track section 1.1, and with the other end in the opposite connecting region of the transverse struts 6 and 6.2 to the other girder element 4.2. Furthermore, it is also possible to connect the second end of this diagonal strut 7.3 to the connecting region of the transverse struts 6 and 6.2 with the other girder element 4.1. At the same time this diagonal strut 7.3 can be connected directly to the other girder element 4.1 or 4.2 or also to a transverse strut 6 or 6.2. An eccentric connection between the diagonal strut 7.3 and the cross beam 5 is also possible. Furthermore, such a fourth stiffening plane A4 can also be achieved by means of a stiffening element 7.3 in the other track sections 1.2 to 1.6.

Finally, in this track element 1, which is designed as a four girder system, the track sections 1.1 to 1.6 may be reinforced with the stiffening struts 8.1, 8.2 and 8.3, which are arranged in the first stiffening plane A1, in accordance with the track sections 1.1 and 1.2 or 1.6 and 1.7 of the track elements 1 according to FIG. 6. The diagonal struts 7.0, 7.1, 7.2 and 7.3, which are described in FIGS. 2 to 6, as well as the stiffening struts 8.1, 8.2 and 8.3 are connected to the cross beams 5 and 5.1 respectively, the transverse struts 6 and 6.1 respectively as well as to the other girder element 4.1 in the same way as disclosed in the European patent EP 2 156 870 B1, which was described in the introductory part. Therefore, the disclosure of this patent specification is hereby incorporated in its entirety by reference.

In particular, these diagonal struts 7.0, 7.1, 7.2 and 7.3 may be arranged in such a way that they do not have to extend from a cross beam 5 or 5.1 directly to the other girder element 4.1, but rather, for example, directly to a column head 9 or to a transverse strut 6 or 6.1 in the area of their connecting points on the other girder element 4.1. Furthermore, it is also possible that these diagonal struts 7.0, 7.1 and 7.2 do not have to be connected to a cross beam 5 or 5.1 in the middle, but rather may also be connected to a transverse strut 6 or 6.1 in the middle.

LIST OF REFERENCE NUMBERS

1 track element of the track system 10
2 first girder element, track of the track element 1
3 second girder element, track of the track element 1
4.1 additional third girder element, tension or compression element of the track element 1
4.11 flange of the tension element 4
4.12 flange of the tension element 4
4.2 additional fourth girder element of the track element 1
5 cross beam
5.1 cross beam with column joint 9
6 transverse strut
6.1 transverse strut with column joint 9
7.0 diagonal strut
7.1 diagonal strut
7.2 diagonal strut
7.3 stiffening element, diagonal strut
7.4 diagonal strut
8.1 first stiffening strut
8.2 second stiffening strut
8.3 third stiffening strut
9 column joint
9.1 column head of the column joint 9
10 track system The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. A track system for amusement rides with truss-like track elements, which consist of at least one three girder system and comprise, as the first and second girder elements, tracks, extending alongside each other, and at least one other girder element, wherein a first stiffening plane is formed by means of the tracks and the cross beams, connecting these tracks; and a second and a third stiffening plane are formed by means of one track and the transverse struts, connecting said track to the at least third girder element; and, in order to form the track sections, the cross beams and the transverse struts are arranged spaced apart, wherein at least one track section, formed by the adjacent cross beams with the associated transverse struts, is designed with a stiffening element, which spans the track section in such a way that the stiffening element together with the other girder element of the track section forms a fourth stiffening plane, wherein one end of the stiffening element is connected to one end of the one crossbeam of the track section.

2. The track system, as claimed in claim 1, wherein the stiffening element diagonally spans the track section.

3. The track system, as claimed in claim 1, wherein the stiffening element, forming the fourth stiffening plane, is connected to the other girder element.

4. The track system, as claimed in claim 1, wherein the stiffening element, forming the fourth stiffening plane, is connected to the traverse strut.

5. The track system, as claimed in claim 1, wherein at least one cross beam with the associated transverse struts is connected to a column joint, comprising a column head; and that the stiffening element, forming the fourth stiffening plane, is connected to the column joint.

6. The track system, as claimed in claim 5, wherein the column joint is designed as a two dimensional element, which has a triangular contour or rectangular contour and which is connected to the cross beam and the two transverse struts in a force fitting manner on the contour side.

7. The track system, as claimed in claim 1, wherein the stiffening element, forming the fourth stiffening plane, is connected preferably centrally to the cross beam.

8. The track system, as claimed in claim 1, wherein the at least one track section has a first and second stiffening strut, which at one end is centrally connected to a cross beam of the track section and at the other end, spanning the track section, is connected in each instance at the opposite cross beam of the track section on the end side to this cross beam or to the transverse struts, connected to this cross beam.

9. The track system, as claimed in claim 1, wherein the at least one track section has a third stiffening strut, which connects the two cross beams of the track section in the middle.

10. The track system, as claimed in claim 1, wherein at least one track section in the first or second or third stiffening plane is constructed with each diagonal strut, spanning the track section.

11. The track system, as claimed in claim 1, wherein the track elements consist of a four girder system and comprise, as a first and second girder element, tracks, running almost parallel to each other, and two other girder elements, wherein the fourth stiffening plane is formed by means of a, which spans the track section in such a way that the stiffening element forms together with one of the other girder elements of the track section a fourth stiffening plane.

12. The track system, as claimed in claim 1, wherein the stiffening element is designed as a diagonal strut.

13. The track system, as claimed in claim 12, wherein the column head is disposed on the least one girder element and, for connecting to a column of the track system, is designed preferably for a roller coaster or suspension railway.

14. An amusement ride, preferably roller coaster or suspension railway with a track system, as claimed in claim 1.

* * * * *